US005944434A

United States Patent [19]

Schlatter

[11] Patent Number: 5,944,434

[45] Date of Patent: Aug. 31, 1999

[54] APPLICATOR PACKAGE

[76] Inventor: Gary Schlatter, 2901 S. Tejon St., Englewood, Colo. 80110

[21] Appl. No.: 08/889,218

[22] Filed: Jul. 8, 1997

[51] Int. Cl.[6] ..... B43K 21/00

[52] U.S. Cl. ..... 401/82; 401/176; 401/55

[58] Field of Search ..... 401/82, 83, 84, 401/87, 176, 52, 118, 55

[56] References Cited

U.S. PATENT DOCUMENTS

| | | | |
|---|---|---|---|
| 381,553 | 4/1888 | Hollis . | |
| 700,947 | 5/1902 | Kendrick | 401/82 |
| 718,969 | 1/1903 | Altshul | 401/176 |
| 2,361,647 | 10/1944 | Nyden | 221/60 |
| 2,371,332 | 3/1945 | Jacobson | 222/386 |
| 2,430,718 | 11/1947 | Jacobson | 222/386 |
| 2,543,190 | 2/1951 | Musekamp | 131/3 |
| 2,626,847 | 1/1953 | Brown | 401/82 |
| 2,887,117 | 5/1959 | Rosholt | 132/107 |
| 3,176,338 | 4/1965 | Homberger | 401/88 |
| 4,023,912 | 5/1977 | Mahler et al. | 401/82 |
| 4,298,036 | 11/1981 | Horvath | 401/82 |
| 4,621,935 | 11/1986 | Sussman | 401/82 |
| 4,645,098 | 2/1987 | Hoffmann | 222/386 |

FOREIGN PATENT DOCUMENTS

| | | | |
|---|---|---|---|
| 1049134 | 1/1952 | France | 222/386 |
| 377541 | 12/1939 | Italy | 221/78 |
| 436754 | 4/1945 | Italy . | |

*Primary Examiner*—David J. Walczak
*Attorney, Agent, or Firm*—Aquilino & Welsh

[57] ABSTRACT

An applicator for dispensing and applying materials. The applicator includes a container having an open first end and an open second end. The applicator also includes a follower sized and dimensioned to fit within the container such that the follower moves between the first end of the container and the second end of the container to force material from the second end of the container. The first end of the container is shaped to accommodate and retain a finger of a user within the first end of the container such that the finger of the user snugly fits within the container and the container becomes an extension of the finger for application purposes.

20 Claims, 2 Drawing Sheets

APPLICATOR PACKAGE

BACKGROUND OF THE INVENTION

1. Field of the Invention

The invention relates to an applicator package. More particularly, the invention relates to an applicator having an internal follower which is contacted by an individual's finger to force material from the applicator. The applicator is shaped to accommodate the individual's finger such that the container snugly fits about the individual's finger and becomes an extension of the finger for application purposes.

2. Description of the Prior Art

Dispensers for applying substantially solid materials, such as lip balm, have been known for sometime. The vast majority of these applicators include a tubular container open at one end to permit the materials to be dispensed therefrom. The other end of the applicator is generally closed to protect a follower stored within the container from being inadvertently damaged. In most of these applicators, the follower is moved within the container through the action of a screw mechanism.

When these applicators are used, an individual must grip the sides of the applicator container with his or her fingers as he or she applies the material stored within the applicator. As such, the applicator container must be sufficiently large to permit an individual to grip the applicator container while he or she applies the material. When a container is too small, the applicator becomes cumbersome to handle. These applicators must, therefore, be manufactured in sizes far larger than dictated by the amount of material held within the applicator container.

The production of applicators in sizes larger than needed results in unnecessary cost and inconvenience associated with the manufacture, shipping and storage of the applicators. A need, therefore, exists for an applicator sized, shaped and designed to overcome the limitation of prior applicators. The present invention provides such an applicator.

SUMMARY OF THE INVENTION

It is, therefore, an object of the present invention to provide an applicator for dispensing and applying materials. The applicator includes a container having an open first end and an open second end. The applicator also includes a follower sized and dimensioned to fit within the container such that the follower moves between the first end of the container and the second end of the container to force material from the second end of the container. The first end of the container is shaped to accommodate and retain a finger of a user within the first end of the container such that the finger of the user snugly fits within the container and the container becomes an extension of the finger for application purposes.

It is also an object of the present invention to provide an applicator wherein the first end of the container has an internal dimension which is within a range of between 7/16 of an inch to 11/16 of an inch.

It is another object of the present invention to provide an applicator wherein the container is cylindrical.

It is a further object of the present invention to provide an applicator wherein the follower is cup shaped and includes a resilient lip that conforms to an inner wall of the container.

It is also an object of the present invention to provide an applicator wherein the follower includes a first side and a second side, and the first end of the container exposes the first side of the follower such that the follower may be contacted by a finger of the user to move the follower between the first end of the container and the second end of the container.

It is another object of the present invention to provide an applicator wherein the container is less than 1½ inches in length, thereby allowing the follower to be pushed from one end to the other by a user's finger.

It is a further object of the present invention to provide an applicator wherein the follower is cup shaped includes a tapered lip with ridges therein for holding the material to be dispensed.

It is also an object of the present invention to provide an applicator wherein the follower is made from plastic having a flexural modulus of 155,000 psi and the container and cup are made from plastic having a flexural modulus of 260,000 psi.

It is another object of the present invention to provide an applicator including a dome-shaped cap to cover the open second end of the container while allowing the material to be dispensed to extend passed the open second end.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
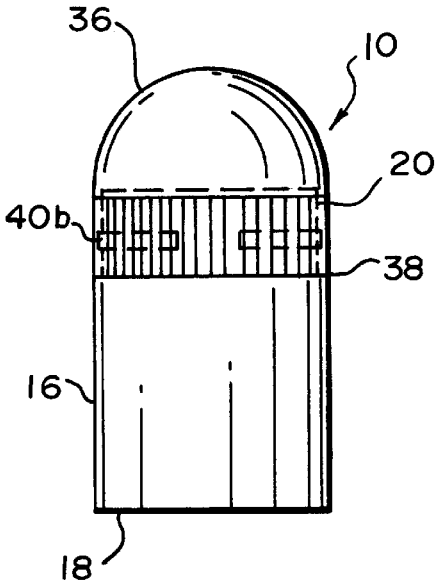
FIG. 1 is a front view of the applicator.
Figure 2:
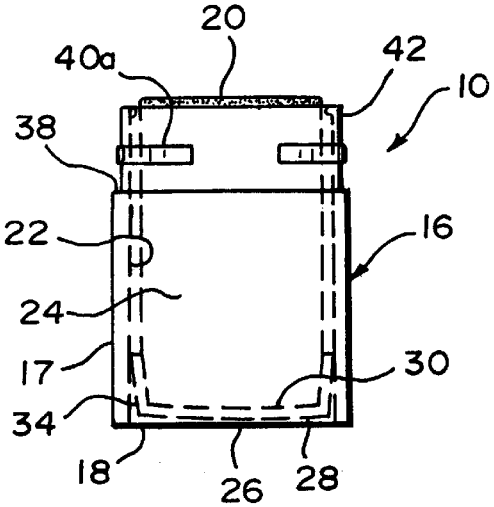
FIG. 2 is a front view of the applicator without the cap showing the follower and material to be dispensed in dotted lines.

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1–7, an applicator 10 for dispensing and applying materials is disclosed. The applicator 10 is particularly designed for the application of lip balm 12, while the applicator 10 becomes an extension of the finger 14 upon which it is placed. In this way, the present applicator 10 can be placed on the tip of an individual's finger 14 when the individual wishes to apply lip balm 12, and the individual need not hold the applicator 10 if they so desire. The present applicator 10 may, therefore, be very small when compared to currently available applicators, since the individual need not hold the present applicator 10 between his or her fingers. It should, however, be understood that while the present applicator 10 is designed for use with lip balm, the applicator 10 could be used to dispense a variety of materials without departing from the spirit of the present invention.

The applicator 10 includes a cylindrical container 16 having an open first end 18 and an open second end 20. The inner wall 22 of the container 16 defines an inner space 24 in which the lip balm 12 is stored. The container is made from a plastic, with or without fillers, preferably polypropylene having a flexural modulus of at least 200,000 psi. The cylindrical container 16 has an exterior gripping surface 17 of less than one inch and an overall length from top to bottom of less than one and a quarter inches. The length of the container is important as it needs to be within a range that permits a user, with a finger, to move the follower from one end of the container to the other in order to fully dispense the product. Specifically, the container 16 should have a length permitting a user to move his or her finger therein without the expanding width of a user's finger interfering with movement within the container 16. For example, the container 16 should not be so long that a user's second knuckle must move within the container in a manner that is discussed in greater detail below.

A cup-shaped follower 26 is positioned within the container 16 and supports the lip balm 12 held therein. The follower 26 includes a first side 28 and a second side 30, wherein the first side 28 faces the open first end 18 of the container 16 and the second side 30 faces the open second end 20 of the container 16. The follower 26 is sized and dimensioned to fit within the container 16 such that the follower 26 moves between the first end 18 of the container 16 and the second end 20 of the container 16 to force the lip balm 12 from the second end 20 of the container 16. The follower 26 is prevented from moving through the second end 20 of the container 16 by a small abutment 32 formed along the inner wall 22 adjacent the second end 20 of the container 16. The abutment 32 extends inwardly to limit the movement of the follower 26 as it approaches the second end 20 of the container 16.

The stability of the follower 26 within the container 16 is enhanced by its cup-shaped design. The cup-shaped design incorporates a resilient lip 34 which extends outwardly on a slight angle from the second side 30 of the follower 26. Thus, the follower 26 has a second end 31 with a diameter which is greater than its first end 27 and the inner diameter of cylindrical container 16, and a first end 27 which is smaller in diameter than second end 31 and the inner diameter of cylindrical container 16.

Figure 3:
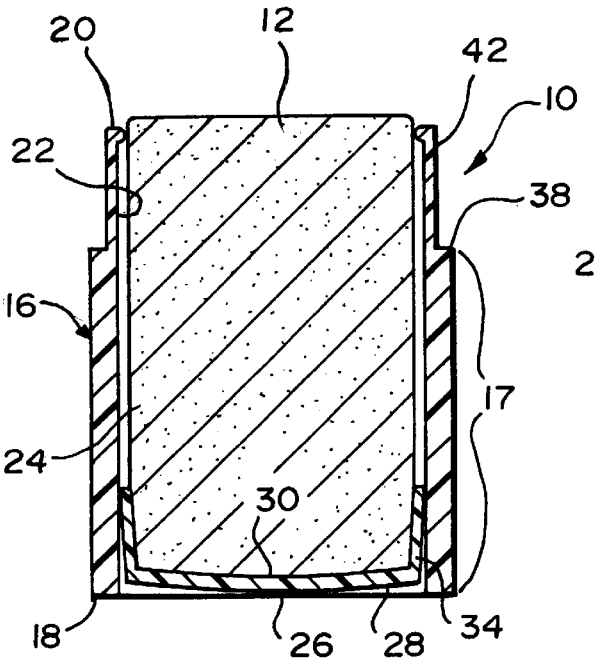
FIG. 3 is a cross sectional view of the applicator.
Figure 4:
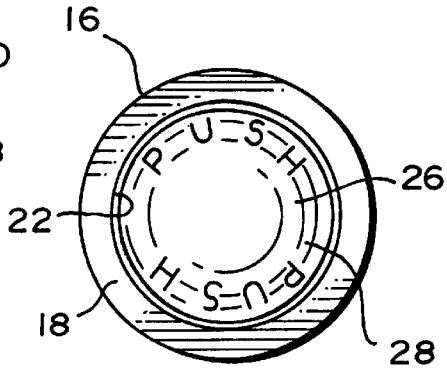
FIG. 4 is a bottom view of the applicator.
Figure 5:
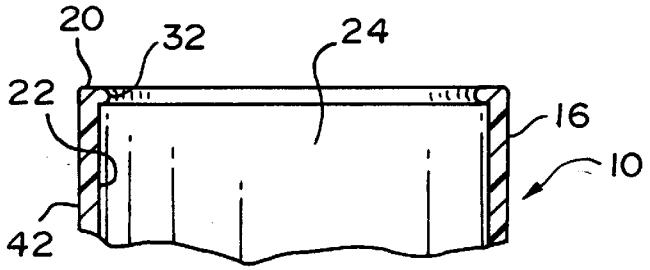
FIG. 5 is detailed view of the second end of the container of the applicator.
Figure 6:
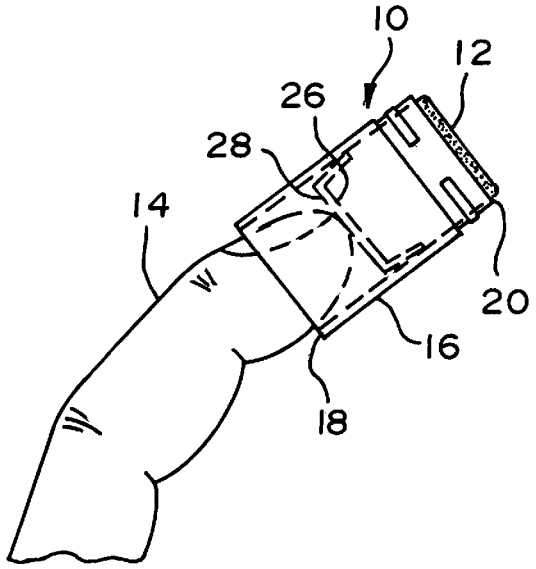
FIG. 6 is a perspective view of the applicator on the finger of a user.

The lip 34 not only maintains the orientation of the follower 26 within the container 16 by its friction fit with inner wall 22, but it also functions as a wiper to remove any lip balm from the inner wall 22 as it moves towards the second open end 20. The angled design of lip 34 allows the follower first end 28 to fit within the container 16 without contacting the inner wall 22, and thus allows the first side 28, and about half of lip 34, to drop into the second end of container 16 for assembly purposes. Once dropped in, the follower 26 can be mechanically pushed down such that the lip 34 flexes and slips over the abutment 32 as the follower 26 is pushed down to a point where the first side 28 is aligned with the first open end 18 of container 16 as shown in FIGS. 3 and 4.

The lip 34 also tapers in width (see FIG. 7), that is, it gets thinner and thus more resilient as it extends away from first end 27. The resilient angled lip design feature allows the follower 26 to move easier within the container as the surface area in contact with the inner wall 22 is minimized.

Figure 7:
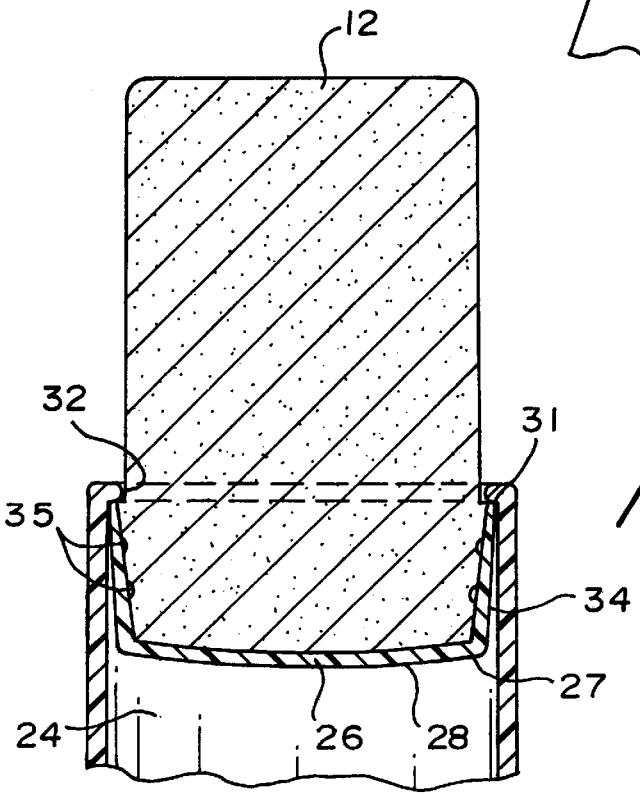
FIG. 7 is an enlarged view showing the details of the follower.

The lip 34 further includes inwardly directed ridges 35 (see FIG. 7). The ridges 35 support and grip the lip balm 12 which sits within and upon the second side 30 of the cup-shaped follower 26. The follower 26 is made from a plastic with or without fillers, preferably a high density polyethylene with flexural modulus of no more than 200,000 psi.

As stated above, the applicator 10 can be used by placing a finger 14 within the open first end 18 of the container 16 such that the container 16 becomes an extension of the finger 14. With this in mind, the first end 18 of the container 16 is shaped to accommodate and retain a finger 14 of a user therein such that the finger 14 of the user snugly fits within the container 16 and the container 16 becomes an extension of the finger 14 for application purposes. The first end 18 of the container 16, therefore, has a diameter which is approximately between 7/16 of an inch to 11/16 of an inch. This range permits the vast majority of individuals to snugly place at least one of their fingers within the first end of the container.

In use, an individual places the tip of his or her finger 14 within the open first end 18 of the container 16. As stated above, the open first end 18 of the container 16 is shaped and sized to receive the tip of an individuals finger 14 in a manner causing the tip of the individual's finger 14 to be snugly held within the first end 18 of the container 16. As the tip of the individual's finger 14 moves within the first end 18 of the container 16, the finger 14 contacts the first side 28 of the follower 26. When the finger 14 pushes upon the first side 28 of the follower 26, the lip balm 12 is forced out of the second end 20 of the container 16. At this point the lip balm 12 may be applied to the lips of the individual.

The lip balm 12 is applied by maintaining the tip of the individual's finger 14 within the first end 18 of the container 16, thereby permitting the applicator 10 to become an extension of the individuals finger 14. As such, the individual moves his or her finger 14 as if he or she were using the tip of the finger to apply the lip balm 12. Since the applicator 10 is held on the tip of the individual's finger 14, the individual need not grip the sides of the applicator container 16 and the container 16 may be manufactured without worrying that it will be too small to be conveniently gripped by an individual desiring to apply the product. The present applicator 10 may, therefore, be manufactured as a compact and convenient package.

The applicator is also provided with a cap 36 to cover the open second end 20 of the container 16 and prevent the materials held within the container 16 from drying out. The cap 36 is dome-shaped and is made from the same material as the container. The dimensions of the cap are such that it can fit over the second end 20 of the container a distance sufficient to allow the lip balm to remain extended past the second end 20 of container 16. Specifically, the cap 36 is shaped to sit on a ledge 38 formed adjacent the second end 20 of the container 16 and frictionally engage the container 16 adjacent its second end 20. As such, frictional engaging members **40*a*, 40*b* are formed on the outer surface 42 adjacent the second end 20 of the container 16 and the inner surface of the cap 36**.

In its final assembled state with cap on the overall length of the applicator is less than one and a half inches. This compact size reduces the amount of space required in a retail store for display and sale of the product which is a benefit desired by all retailers.

The material property of flexural modulus is an important consideration as the container cannot be too flexible or the lip balm could crack if the container is improperly squeezed. The cap should be the same material as the container to prevent expansion and contraction at different rates, causing an improper friction fit. The follower should be made from a material compatible with the container to allow the follower to slide therealong. The follower should be sufficiently resilient to allow for a flexible lip which can flex around abutment 32 during assembly and serve as a wiper during use.

While the preferred embodiment have been shown and described, it will be understood that there is no intent to limit the invention by such disclosure, but rather, is intended to cover all modifications and alternate constructions falling within the spirit and scope of the invention as defined in the appended claims.

I claim:

1. An applicator for dispensing and applying materials, comprising:

a container having an open first end and an open second end;

a follower sized and dimensioned to fit within the container such that the follower moves between the first end of the container and the second end of the container to force material from the second end of the container;

the first end of the container including a finger accommodating opening which retains a finger of a user within the first end of the container such that the finger of the user snugly fits within the container and the container becomes an extension of the finger for application purposes.

2. The applicator according to claim 1, wherein the first end of the container has an internal diameter ranging in size from approximately 7/16 of an inch to 11/16 of an inch.

3. The applicator according to claim 1, wherein the container is cylindrical and is of a length less than one and a quarter inches.

4. The applicator according to claim 1, wherein the follower is cup shaped having a lip which is angled outwardly from said first end towards said second end and frictionally engages an inner wall of the container.

5. The applicator according to claim 1, wherein the follower includes a first side and a second side, and the open first end exposes the first side of the follower such that the follower may be contacted by a finger and the second side includes a lip with ridges thereon for holding the material to be dispensed.

6. The applicator according to claim 1, wherein the container is made from a material having a flexural modulus of at least 200,000 psi.

7. The applicator according to claim 6, wherein the container is made from polypropylene.

8. The applicator according to claim 1, wherein the follower is made from a material having flexural modulus of no more than 200,000 psi.

9. The applicator according to claim 8, wherein the follower is made from polyethylene.

10. The applicator according to claim 1, further including a cap made from the same material as the container which is dome-shaped thereby extending a distance above the open second end of the container which permits the material being dispensed to remain extended past the open second end when the cap is secured to the container.

11. An applicator for dispensing and applying materials, comprising:

a container having an open first end and an open second end;

a follower sized and dimensioned to fit within the container such that the follower moves between the first end of the container and the second end of the container to force material from the second end of the container;

the first end of the container having an internal diameter which is less than ¾ of an inch and a length less than one and a half inches, wherein the first end of the container is shaped and dimensioned to accommodate and retain a finger of a user within the first end of the container such that the finger of the user snugly fits within the container and the container becomes an extension of the finger for application purposes.

12. The applicator according to claim 11, wherein the container is cylindrical and the internal diameter of the container is within a range of 7/16 of an inch to 11/16 of an inch.

13. The applicator according to claim 11, wherein the follower is cup shaped having a lip which is angled outwardly from said first end towards said second end and frictionally engages an inner wall of the container.

14. The applicator according to claim 11, wherein the follower includes a first side and a second side, and the open first end exposes the first side of the follower such that the follower may be contacted by a finger and the second side includes a lip with ridges thereon for holding the material to be dispensed.

15. The applicator according to claim 11, wherein the container is cylindrical and is of a length of less than one and a quarter inches.

16. The applicator according to claim 11, wherein the container is made from a material having a flexural modulus of at least 200,000 psi.

17. The applicator according to claim 16, wherein the container is made from polypropylene.

18. The applicator according to claim 11, wherein the follower is made from a material having flexural modulus of no more than 200,000 psi.

19. The applicator according to claim 18, wherein the follower is made from polyethylene.

20. The applicator according to claim 11, further including a cap made from the same material as the container which is dome-shaped thereby extending a distance above the open second end of the container which permits the material being dispensed to remain extended past the open second end when the cap is secured to the container.

* * * * *